United States Patent [19]

Golightly

[11] Patent Number: 4,993,714

[45] Date of Patent: Feb. 19, 1991

[54] POINT OF SALE LOTTERY SYSTEM

[76] Inventor: Cecelia K. Golightly, 360 S. Lexington Pkwy., Apt. 302, St. Paul, Minn. 55105

[21] Appl. No.: 500,073

[22] Filed: Mar. 27, 1990

[51] Int. Cl.[5] ..... A63F 9/00

[52] U.S. Cl. ..... 273/138 A

[58] Field of Search ..... 273/138 A, 139

[56] References Cited

U.S. PATENT DOCUMENTS

| | | | |
|---|---|---|---|
| 1,867,432 | 7/1932 | Wright . | |
| 1,999,485 | 4/1935 | Smith | 273/138 |
| 2,593,631 | 4/1952 | Tognetti | 273/135 |
| 3,533,629 | 10/1970 | Raven | 273/138 |
| 3,594,004 | 7/1971 | Barr | 273/139 |
| 3,998,465 | 12/1976 | Mascola | 273/139 |
| 4,033,588 | 7/1977 | Watts | 273/139 |
| 4,373,726 | 2/1983 | Churchill et al. | 273/138 A |
| 4,832,341 | 5/1989 | Muller et al. | 273/139 |
| 4,854,590 | 8/1989 | Jolliff et al. | 273/138 A |

*Primary Examiner*—William H. Grieb

*Attorney, Agent, or Firm*—Kinney & Lange

[57] ABSTRACT

A lottery ticket is generated from a customer receipt by listing on the receipt the UPC codes of the items purchased by the customer. The UPC codes can be used as lottery numbers. To enhance security, it is optional to subject the UPC numerical codes on each receipt to a predetermined numerical algorithm to generate a lottery number. The lottery numbers generated are stored to memory of the inventory computer, and, once a week, or some other period, the computer randomly selects one or more of the stored numbers as winning numbers. The winning numbers are posted to allow the players to match the lottery numbers of their receipts to the winning number list. Forgery is discouraged by reexecution of the numerical algorithm on the UPC numbers on the receipt as a check of the lottery number on the receipt.

10 Claims, 2 Drawing Sheets

POINT OF SALE LOTTERY SYSTEM

BACKGROUND OF THE INVENTION

The invention relates to lottery systems for use in connection with point of sale promotions. More particularly, the invention provides a promotional lottery system for generating lottery numbers and verification of the accuracy of lottery numbers on receipts generated at the point of purchase.

In conventional lottery games a contestant receives a lottery ticket which has a lottery number inscribed on it. Each lottery number is unique and serves to distinguish the ticket from every other ticket. The winning number or numbers are selected at a date after distribution, preferably in a random manner to defeat prediction upon the part of the contestants. It is known for the lottery ticket to have both a serial number and a lottery number. In some systems a complex mathematical relationship exists between the serial number and the lottery number. Execution of an algorithm on the serial number allows verification of the lottery number as the winning number. This serves to discourage tampering with the ticket.

In instant lotteries, the winning number is determined before sale of the ticket. This allows a contestant to determine virtually immediately whether he or she has a winning ticket. Instant lottery systems require a high degree of security to prevent tampering with tickets and to prevent discovery of the lottery number of the tickets prior to sale. The location of the winning ticket or tickets is also kept secret.

Prevention of fraud in a lottery system can consume a great deal of administrative time. Such burdens can make use of lottery like systems for point of sale promotions burdensome. The invention disclosed herein provides a relatively secure lottery system, using common inventory tracking equipment used in merchandising operations.

SUMMARY OF THE INVENTION

A lottery system provides for the generation of lottery tickets from a customer receipt by listing on the receipt the numerical codes of the Uniform Product Code ("UPC") for the items purchased by the customer. The UPC codes can be used as lottery numbers. To enhance security, the UPC numerical codes listed on a receipt serve as but variables in a predetermined numerical algorithm, which is executed to generate a lottery number. The lottery numbers generated are stored to memory of the inventory computer, and, once a week, or some other period, the computer randomly selects one or more of the stored numbers as winning numbers. The winning numbers are posted to allow the players to match the lottery numbers of their receipts to the winning number list. Forgery is discouraged by re-execution of the numerical algorithm on the UPC numbers on the receipt as a check of the lottery number on the receipt. An alternative instant lottery system uses a predetermined winning number.

DETAILED DESCRIPTION OF THE PREFERRED EMBODIMENT

Figure 1:
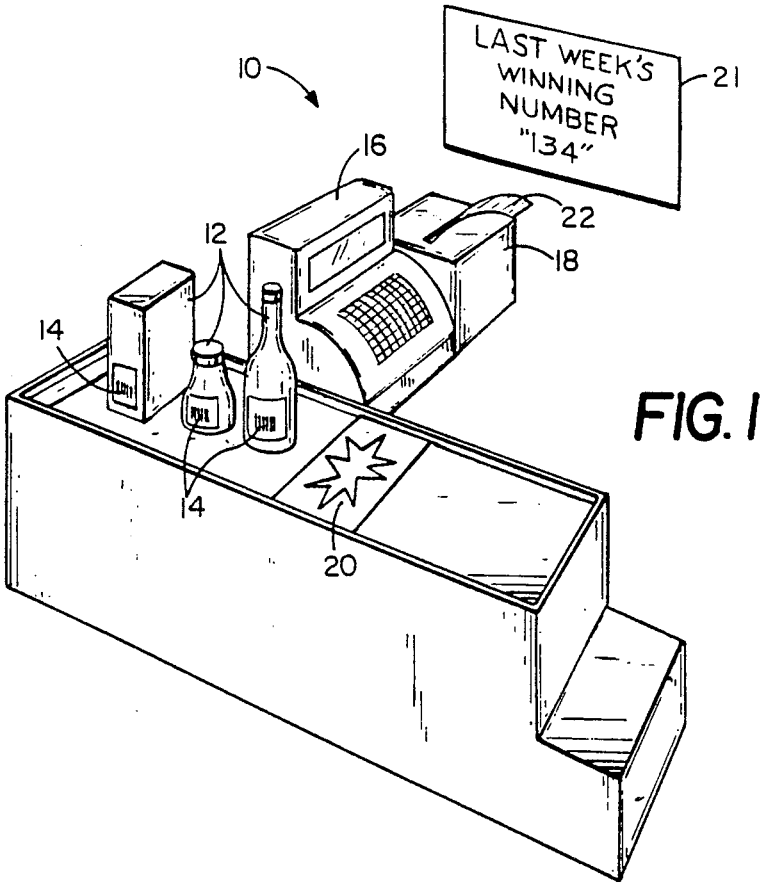
FIG. 1 is a perspective view of a check out lane for a merchandising operation.

FIG. 1 illustrates a check out lane 10. Checkout lane 10 includes a cash register 16 and receipt printer 18 connected to a central inventory computer (shown in FIG. 5). Receipt printer 18 prints customer receipt/lottery tickets 22 after tallying of merchandise 12 selected by a shopper for purchase. Checkout lane 10 also includes a scanning unit 20 for reading bar codes 14 representing the Uniform Product Code number for individual items purchased. It will be understood by those skilled in the art that alternative product numbering systems may be used, for example, the European Article Numbering System Code ("EAN"). A clerk tallies product code numbers for merchandise either by reading and directly entering the product code through cash register 16 or by passing merchandise 12 over scanning unit 20, which reads the product code from the bar codes 14 on the products. Hanging over checkout lane 10 is a poster 21 bearing current winning lottery numbers. Current winning numbers can be numbers for an immediate past period, or numbers for instant winners.

Figure 2:
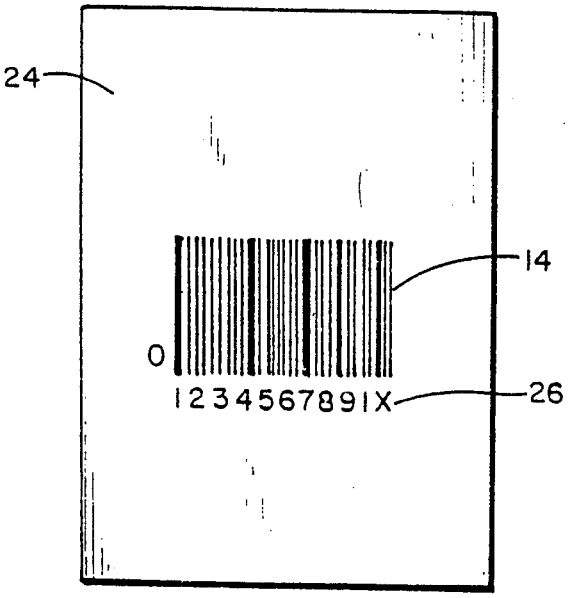
FIG. 2 is a front plan view of uniform product code bar code label.

FIG. 2 illustrates a Uniform Product Code label 24 exemplary of labels as applied or printed on merchandise. Label 24 includes an individual product number 26 and a bar code representation 14 of the product number.

Figure 3:
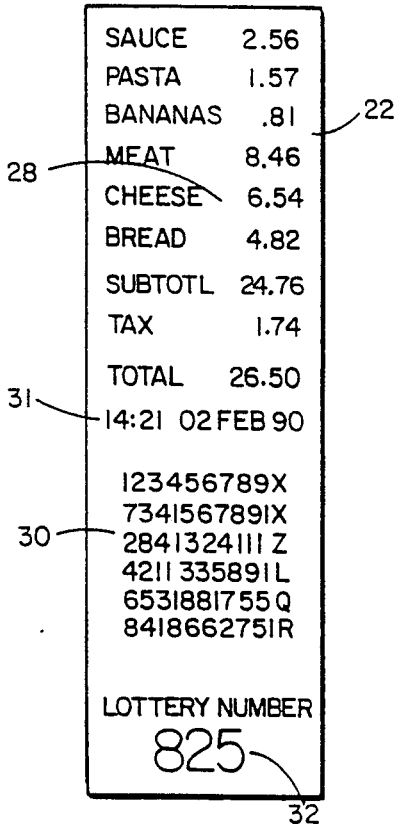
FIG. 3 is a front plan view of a customer receipt/lottery ticket generated in a first embodiment of the present invention.

FIG. 3 illustrates a customer receipt/lottery ticket 22 (hereinafter "receipt") printed on printer 18 in checkout lane 10 (shown in FIG. 1). The upper portion of receipt includes a listing 28 of merchandise purchased and dollar amounts for individual items. Listing 28 also includes a dollar subtotal, a tax line and a total amount due line. Below listing 28 is a line 31 indicating the time and date of issue of receipt 22. The time and date of issuance of receipt allow easy location of a data base record created upon issuance of receipt 22. Below the time/date line 31 is a listing 30 of Uniform Product Code product numbers for the merchandise purchased. According to one embodiment of the invention, one or more product codes may be selected as winning lottery numbers for receipts issued during a given period. The numbers from list 30 may then be compared to a posting of winning numbers. The date/time line 31 may be checked against data base records to determine whether the receipt 22 presented was actually issued. Upon location of a data base record for receipt 22 the contents of the record may be compared against the receipt as a check against tampering and against repeated claims for the prize. Depending upon the lottery system used, a lottery number 32 may also appear somewhere on receipt 22. Where a lottery number 32 is used the number is generated by a mathematical algorithm using the product code numbers from listing 30 as numerical inputs.

Figure 4:
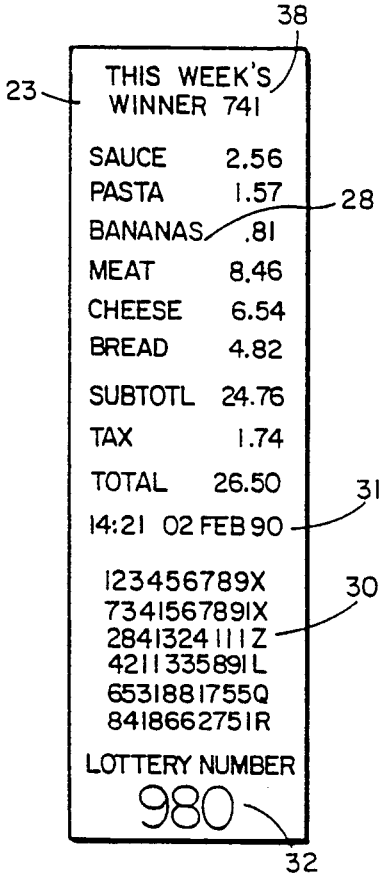
FIG. 4 is a front plan view of a customer receipt/lottery ticket generated in a second embodiment of the present invention.

FIG. 4 illustrates an alternative receipt 23 for an instant lottery system. Receipt 23 carries the same information as receipt 22 in FIG. 3, including a listing 28 of merchandise purchased, a time/date line 31, a listing 30 of product code numbers and a lottery number 32 derived from the product code numbers. Receipt 23 also lists a winning number 38, which appears at the top of the receipt.

Figure 5:
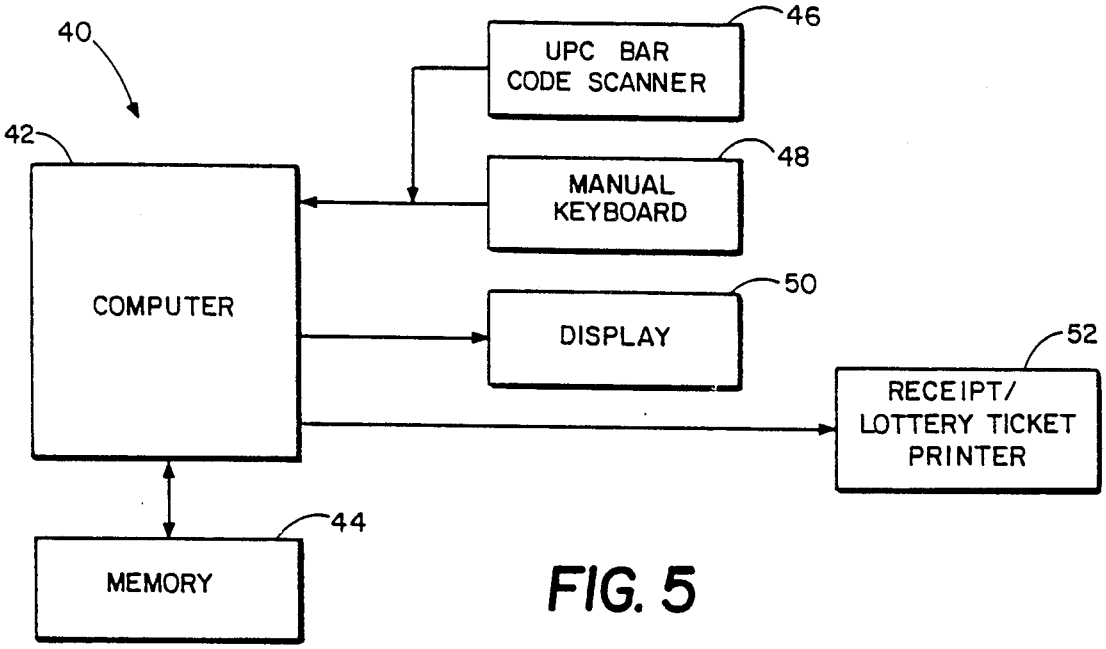
FIG. 5 is a block diagram of the computer controlled inventory system adapted to execute the lottery system of the present invention.

FIG. 5 illustrates a inventory system 40 with which the present inventive lottery systems can be executed. An inventory computer 42 is provided for tracking inventory stocks and identifying products by their UPC codes. Computer 42 has access to memory 44 for storage of programs, data and data base records. Computer 42 is also connected to various peripheral devices, including a UPC bar code scanner 46, a manual keyboard 48, a display 50 and a receipt/lottery ticket printer 52. Upon scanning or manual entry of product code numbers at scanner 46 or keyboard 48, computer 42 tallies the products purchased and formats the data to be transmitted to printer 52 for printing. The data for each receipt printed is also maintained as a data base record identified by date and time in memory 44. Upon presentation of a receipt for claiming a prize, the record may be reprinted for comparison to the presented receipt and verification of validity.

Computer 42 in accordance with two embodiments of the invention is used to execute an algorithm on the product numbers to create a lottery number, which is added to a receipt and to the data base record for the purchase. Computer 42 in a retail outlet using point of sale scanning creates records of all transactions at individual checkout lanes. Modification of the system to handle the records created by one of the lottery systems of the present invention involves an extension of system software well within the capabilities of those skilled in the art.

Although the present invention has been described with reference to preferred embodiments, workers skilled in the art will recognize that changes may be made in form and detail without departing from the spirit and scope of the invention.

What is claimed is:

1. A method of playing a lottery game comprising the steps of:

marking merchandise with a product code numbering system;

tallying the product code numbers for the merchandise purchased by a shopper;

performing an algorithm on the product code numbers for the merchandise purchased and generating a lottery number therefrom;

printing a consumer receipt itemizing the product code numbers for the merchandise purchased and listing the generated lottery number thereon; and selecting a winning lottery number from among the generated numbers.

2. The method of claim and further comprising the steps of:

retaining a record of the contents of each consumer receipt printed in a data base; and comparing the contents of a consumer receipt against the records of the data base upon presentation of receipt for claiming of a prize.

3. A method for playing an instant lottery system, the method comprising the steps of:

marking merchandise with a product code numbering system;

tallying the product code numbers of the merchandise purchased by a shopper;

performing an algorithm on the tallied product code numbers for the merchandise purchased for generating a lottery number;

printing a consumer receipt itemizing the product code numbers for the merchandise purchased and listing the generated lottery number thereon; and checking the generated lottery number for a match to a preselected winning lottery number.

4. The method of claim 3 and further comprising the steps of:

retaining a record of the contents of each consumer receipt printed in a data base; and comparing the contents of a consumer receipt against the records of the data base upon presentation of receipt for claiming of a prize.

5. A lottery system comprising:

merchandise marked with a product code numbering system including bar codes indicating the product code number;

a point of sale scanning system for tallying the merchandise purchased by a shopper;

means performing an algorithm on the product code numbers for the tailed merchandise purchased for generating a lottery number;

means for printing a consumer receipt itemizing the merchandise purchased, the product code numbers for the merchandise purchased and listing the generated lottery number; and means for selecting a winning lottery number from among the generated numbers.

6. The lottery system of claim 5 and further comprising:

means for retaining a record of the contents of each consumer receipt printed in a data base; and means for comparing the contents of a consumer receipt against the records of the data base upon presentation of receipt for claiming of a prize.

7. An instant lottery system comprising:

merchandise marked with a product code numbering system including bar codes indicating the product code number;

a point of sale scanning system for tallying the merchandise purchased by a shopper;

means performing an algorithm on the product code numbers for the tailed merchandise purchased for generating a lottery number; and means for checking the generated lottery number for a match to a preselected winning lottery number.

8. The lottery system of claim 7 and further comprising:

means for retaining a record of the contents of each consumer receipt printed in a data base; and means for comparing the contents of a consumer receipt against the records of the data base upon presentation of receipt for claiming of a prize.

9. A method of playing a lottery game comprising the steps of:

marking merchandise with a product code numbering system;

tallying the product code numbers for the merchandise purchased by a shopper;

printing a consumer receipt itemizing the product code numbers for the merchandise purchased;

generating a data base preserving record of all consumer receipts generated for verification of winning receipts; and selecting a winning lottery number from among product code numbers.

10. A lottery system comprising:

merchandise marked with a product code numbering system including bar codes indicating the product code number;

means for tallying the product code numbers for merchandise purchased by a shopper;

means for printing a consumer receipt itemizing the product code numbers for the merchandise purchased;

means for generating a data base preserving record of all consumer receipts generated for verification of winning receipts; and means for selecting a winning lottery number from among the product code numbers.

* * * * *

UNITED STATES PATENT AND TRADEMARK OFFICE

CERTIFICATE OF CORRECTION

PATENT NO. : 4,993,714

DATED : February 19, 1991

INVENTOR(S) : Cecelia King Golightly

It is certified that error appears in the above-identified patent and that said Letters Patent is hereby corrected as shown below:

Col. 3, line 54, delete "claim, insert --claim 1--.

Col. 4, line 23, delete "tailed", insert --tallied--.

Col. 4, line 45, delete "tailed", insert --tallied--.

Signed and Sealed this

Twenty-third Day of June, 1992

*Attest:*

DOUGLAS B. COMER

*Attesting Officer*

*Acting Commissioner of Patents and Trademarks*